US008029076B2

(12) United States Patent
Greiner

(10) Patent No.: US 8,029,076 B2
(45) Date of Patent: Oct. 4, 2011

(54) JEWELRY CABINET

(75) Inventor: Lori Greiner, Chicago, IL (US)

(73) Assignee: For Your Ease Only, Inc., Chicago, IL (US)

( * ) Notice: Subject to any disclaimer, the term of this patent is extended or adjusted under 35 U.S.C. 154(b) by 0 days.

(21) Appl. No.: 12/685,093

(22) Filed: Jan. 11, 2010

(65) Prior Publication Data

US 2010/0133965 A1 Jun. 3, 2010

Related U.S. Application Data

(62) Division of application No. 10/809,030, filed on Mar. 25, 2004, now Pat. No. 7,651,178.

(60) Provisional application No. 60/516,913, filed on Nov. 3, 2003.

(51) Int. Cl.
*A47B 67/00* (2006.01)

(52) U.S. Cl. ..... 312/226; 312/351.4; 248/474; 248/140

(58) Field of Classification Search ..... None
See application file for complete search history.

(56) References Cited

U.S. PATENT DOCUMENTS

| | | | |
|---|---|---|---|
| 947,640 | A | 1/1910 | Jefferson |
| 1,705,580 | A | 3/1929 | Marburger |
| 1,751,569 | A | 5/1930 | Ross |
| 2,448,300 | A | 8/1948 | Eaddy |
| 2,505,723 | A | 4/1950 | Rees |
| D237,234 | S | 10/1975 | Wertz |
| 3,930,702 | A | 1/1976 | Pichowicz |
| D243,136 | S | 1/1977 | Foster |
| 4,076,350 | A | 2/1978 | Crist |
| 4,209,212 | A | 6/1980 | McGoldrick |
| 4,282,975 | A | 8/1981 | Ovadia |
| 4,324,446 | A | 4/1982 | LeSage |
| 4,396,240 | A | 8/1983 | Henson |
| D280,876 | S | 10/1985 | Chabanet |
| D297,087 | S | 8/1988 | Fortescue |
| 4,776,650 | A | 10/1988 | Ferenzi |
| D303,894 | S | 10/1989 | Baus |
| D321,451 | S | 11/1991 | Greve |
| 5,127,719 | A | 7/1992 | Battista |
| 5,141,188 | A | 8/1992 | DeBlasi et al. |

(Continued)

FOREIGN PATENT DOCUMENTS

CN 2076350 U 5/1991

(Continued)

OTHER PUBLICATIONS

Translation of Search Report for Utility Model Patent performed by the State Intellectual Property Office of China for Patent No. ZI200520011882.8, May 30, 2007.

(Continued)

*Primary Examiner* — Hanh V Tran
(74) *Attorney, Agent, or Firm* — Fredrikson & Byron, P.A.

(57) ABSTRACT

A jewelry storage system for storing and allowing access to and removal of jewelry pieces includes a jewelry cabinet and a stand. The jewelry cabinet defines an interior space for holding jewelry items. The jewelry cabinet includes a box frame and a door connected to the box frame wherein the door extends substantially from the top wall to the bottom wall. A plurality of jewelry storage elements are attached within the interior space. In one embodiment, a stand is configured to receive the jewelry cabinet to hold the jewelry cabinet in an upright position so that the back wall of the jewelry cabinet forms an angle from the horizontal.

22 Claims, 16 Drawing Sheets

U.S. PATENT DOCUMENTS

| | | | |
|---|---|---|---|
| 5,141,300 | A | 8/1992 | Ciesla |
| 5,163,745 | A | 11/1992 | Zagata |
| 5,242,048 | A | 9/1993 | Ellingsworth et al. |
| 5,368,378 | A | 11/1994 | Curtis |
| D366,796 | S | 2/1996 | Crowley |
| 5,511,873 | A | 4/1996 | Mech |
| D383,937 | S | 9/1997 | Myers |
| 5,681,100 | A | 10/1997 | Powell |
| D394,762 | S | 6/1998 | Greiner |
| 5,762,184 | A | 6/1998 | Greiner |
| D395,768 | S | 7/1998 | Greiner |
| 6,158,578 | A | 12/2000 | Greiner |
| 6,361,130 | B1 | 3/2002 | Kardy |
| 6,595,609 | B1 | 7/2003 | Greiner |
| 6,857,519 | B2 | 2/2005 | Daetweiler et al. |
| 2001/0045400 | A1 | 11/2001 | Caplan |
| 2003/0146678 | A1 | 8/2003 | Greiner |
| 2004/0000848 | A1 | 1/2004 | Greiner |

FOREIGN PATENT DOCUMENTS

| | | | |
|---|---|---|---|
| CN | 2421894 | Y | 3/2001 |
| CN | 1350688 | A | 5/2002 |
| JP | 08089325 | | 4/1996 |
| WO | 9900005 | | 1/1999 |

OTHER PUBLICATIONS

"Jewelry-Closet™ Cabinet," http://web.archive.org/web/20031026073135/www.mingocustomwoods.com, 3 pages (Aug. 2000).

Fine Wood Working: Greene and Greene, Sep. 1978; No. 12; p. 51.

Fine Wood Working: Woodworking in Mendocino, Jul./Aug. 1981, No. 29; p. 37.

Fine Wood Working: Picture Framing; Jul./Aug. 1982; No. 35; p. 88.

Fine Wood Working: Furnituremaking in the Northwest; Mar./Apr. 1983; No. 39; p. 80.

Fine Wood Working: Building a Secretair-Bookcase; Jan./Feb. 1983; No. 38; p. 98.

Fine Wood Working: Making Cabriole Legs; Sep./Oct. 1984; No. 42; p. 71.

Fine Wood Working: Painted Chests; Sep./Oct. 1983; No. 48; p. 32.

Fine Wood Working: Tage Frid; May/Jun. 1985; No. 52; p. 69.

Fine Wood Working: Turning-Up a Tablesaw; Sep./Oct. 1989; No. 78; p. 51.

Fine Wood Working: Woodworking in Hawaii; Aug. 1990; No. 83; p. 38.

Fine Wood Working: Krenov Students' Show; Dec. 1991; No. 91; p. 96.

Fine Wood Working: Cabinet Lighting; Aug. 1993; No. 101; by Jean Sousa.

redENVELOPE catalog; Gifts for Valentine's Day 2004; pp. 30 and 32C.

12
14
20
18
22
60
32
62
46
50
44
30
54
40
42
50
58
52
50
70
72
74
48
56
54

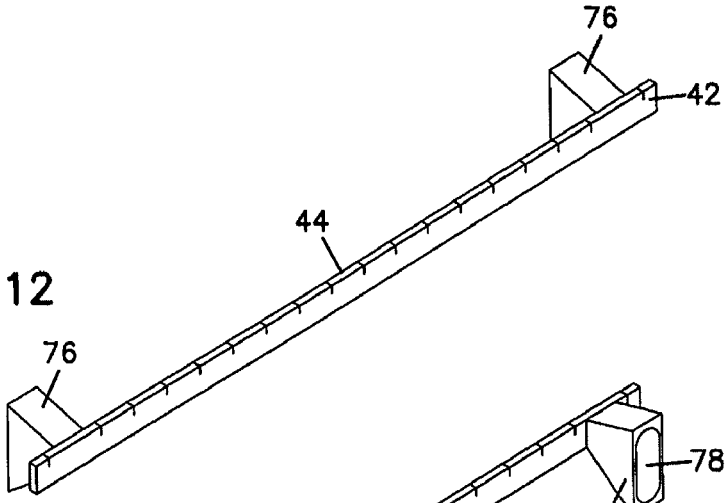
FIG.12
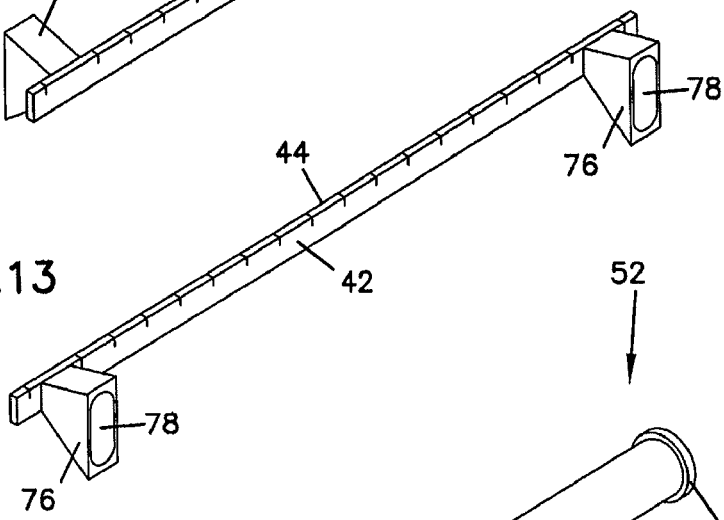
FIG.13
FIG.14
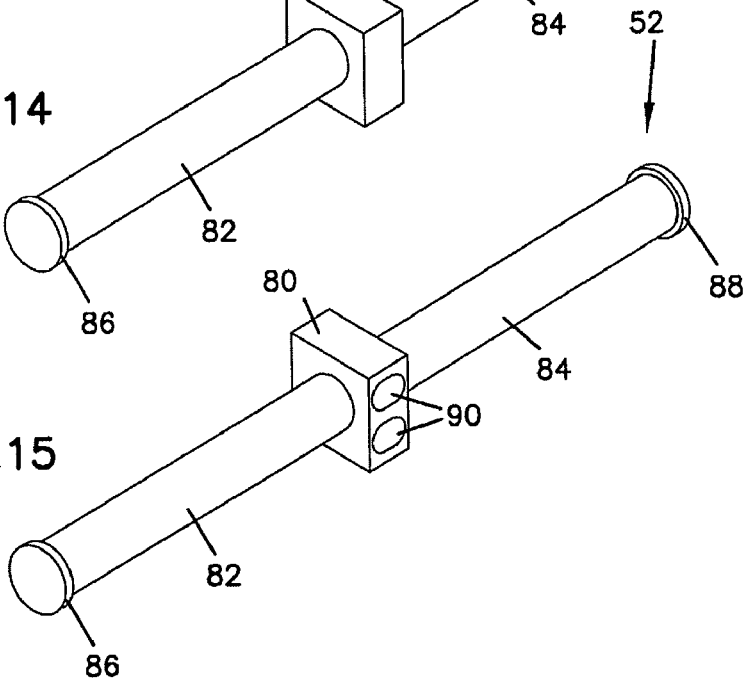
FIG.15

JEWELRY CABINET

RELATED APPLICATIONS

This application is a Divisional of U.S. application Ser. No. 10/809,030, titled "Jewelry Cabinet," filed Mar. 25, 2004, which claims the benefit of Provisional Application No. 60/516,913, titled "Jewelry Cabinet," filed on Nov. 3, 2003, the contents of each of which are hereby incorporated by reference.

FIELD OF THE INVENTION

The present invention is directed to an arrangement for a cabinet for storing jewelry, more particularly to a cabinet including a number of different devices for organizing various types of jewelry, where the cabinet may optionally be mounted on a wall or held in a stand.

BACKGROUND OF THE INVENTION

Jewelry holders are known that allow the display of many different types of jewelry simultaneously. However, there is a need for a jewelry holder that displays jewelry in an easy to access format. Additionally, there is a need for a jewelry holder that may either be free standing or mounted to a wall.

SUMMARY OF THE INVENTION

According to a first aspect of the invention, a jewelry storage system for storing and allowing access to and removal of jewelry pieces includes a jewelry cabinet defining an interior space. The jewelry cabinet has a box frame with a top wall, bottom wall, two sidewalls and a back wall. The jewelry cabinet also has a door connected to the box frame, and the door extends substantially from the top wall to the bottom wall. A plurality of jewelry storage elements is attached within the interior space. The jewelry storage system also includes a stand that is configured to receive the jewelry cabinet. The stand holds the jewelry cabinet in an upright position so that the back wall of the jewelry cabinet forms an angle $\alpha$ from the horizontal.

According to a second aspect of the invention, a mirrored jewelry storage system for storing and allowing access to and removal of jewelry pieces includes a jewelry cabinet defining an interior space. The jewelry cabinet has a box frame including a top wall, bottom wall, two sidewalls and a back wall. The jewelry cabinet also has a door connected to the box frame and a mirror is included on an exterior surface of the door. A plurality of jewelry storage elements is attached within the interior space. The jewelry storage system also includes a stand configured to receive the jewelry cabinet so that the back wall of the jewelry cabinet forms an angle $\alpha$ from the horizontal. The jewelry cabinet is capable of being pivoted with respect to the stand so that it can move between a first position useful for accessing the interior space where the angle $\alpha$ is about 90 degrees and a second position useful for using the mirror where the angle $\alpha$ is less than 90 degrees.

According to a third aspect of the invention, a jewelry cabinet system for storing and allowing access to and removal of jewelry pieces has at least one movable component. The jewelry cabinet system includes a jewelry cabinet that defines an interior space. The jewelry cabinet includes a box frame with a top wall, bottom wall, two sidewalls and a back wall. A door that extends substantially from the top wall to the bottom wall is connected to the box frame. A plurality of jewelry storage elements is attached within the interior space. The plurality of jewelry storage elements includes at least two different jewelry storage elements selected from a group consisting of a horizontal bracelet bar, an earring bar having a plurality of slits, a hook bar having a plurality of hooks, and a shelf. In addition, at least one of the plurality of jewelry storage elements is capable of being relocated within the jewelry cabinet.

According to a fourth aspect of the invention, a jewelry cabinet system for storing and allowing access to and removal of jewelry pieces includes a jewelry cabinet defining an interior space. The jewelry cabinet includes a box frame with a top wall, bottom wall, two sidewalls and a back wall. A door that extends substantially from the top wall to the bottom wall is connected to the box frame. A plurality of jewelry storage elements are attached within the interior space. The plurality of jewelry storage elements includes a horizontal bracelet bar attached to one of the box frame and the door. The bracelet bar is attached to one of the box frame and door via a mounting element. The mounting element is configured so that access to at least one end of the bracelet bar is unobstructed by the mounting element.

According to a fifth aspect of the invention, a jewelry storage system for storing and allowing access to and removal of jewelry pieces in a wall-mounted or free-standing format includes a jewelry cabinet defining an interior space. The jewelry cabinet includes a box frame with a top wall, bottom wall, two sidewalls and a back wall. A door is connected to the box frame. A plurality of jewelry storage elements is attached within the interior space. A mounting structure on an outer side of the back wall of the box frame is configured so that the jewelry cabinet can be hung on a vertical surface. The jewelry storage system also includes a stand for receiving the jewelry cabinet. The jewelry cabinet is configured to be received by the vertical stand so that the back wall of the jewelry cabinet forms an angle of about 90 degrees from the horizontal.

BRIEF DESCRIPTION OF THE DRAWINGS

The invention may be more completely understood by considering the detailed description of various embodiments of the invention, which follows in connection with the accompanying drawings.

FIG. 12 is a front perspective view of the earring bar of FIG. 7.

FIG. 13 is a rear perspective view of the earring bar of FIG. 7.

FIG. 14 is a front perspective view of a bracelet bar that may be included in some embodiments of the jewelry cabinet.

FIG. 15 is a rear perspective view of the bracelet bar of FIG. 14.

Figure 1:
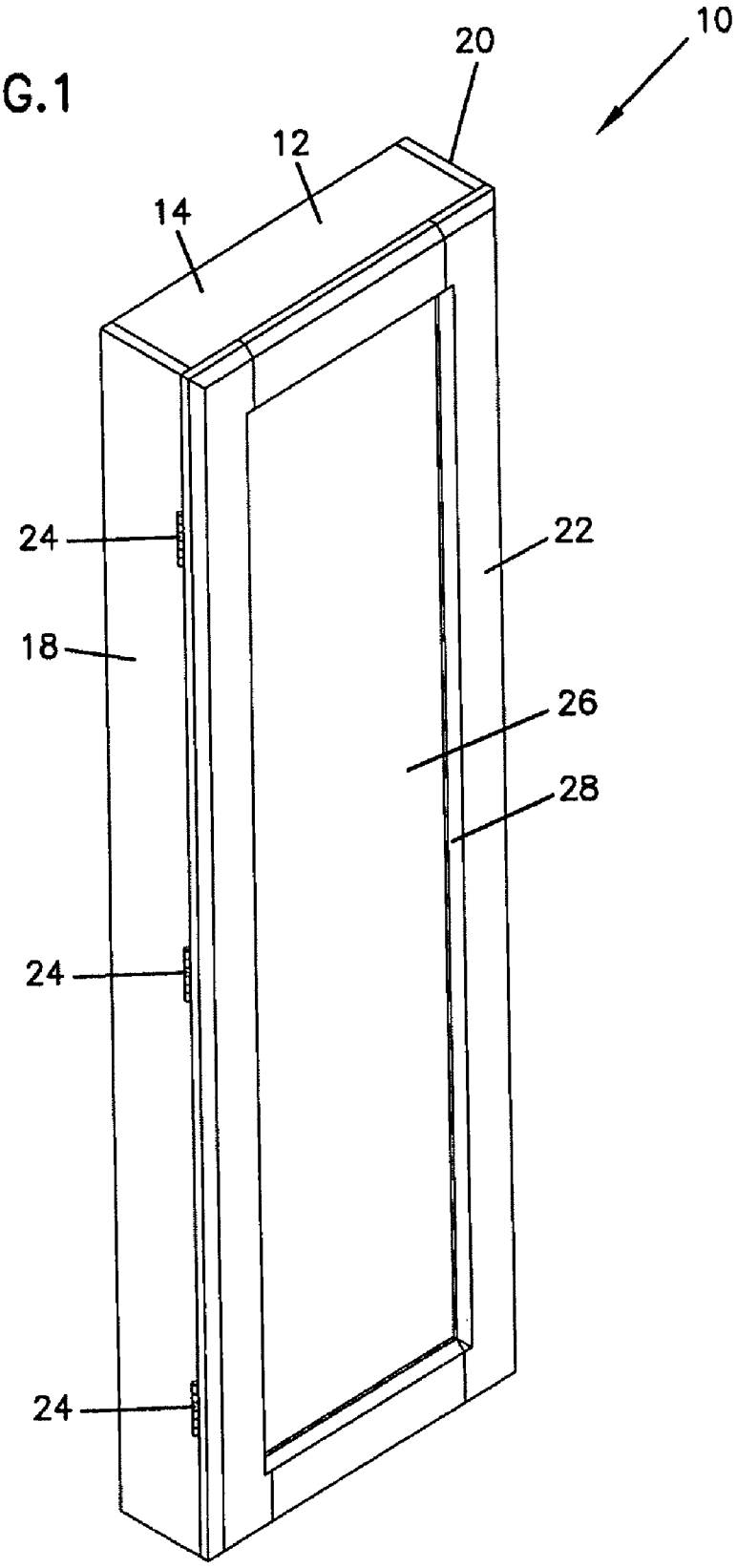
FIG. 1 is a front perspective view of a jewelry cabinet in a closed position according to the present invention.

While the invention is amenable to various modifications and alternative forms, specifics thereof have been shown by way of example in the drawings and will be described in detail. It should be understood that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENT

The present invention is believed to be applicable to a variety of systems and arrangements for storing and displaying jewelry in a container that allows easy access to the jewelry.

One embodiment of the invention is particularly advantageous where it is desirable to store a variety of jewelry in a jewelry cabinet that is configured to be held by a stand. This system is also especially advantageous when it is desired to have a mirror that is attached to the jewelry cabinet. The attached mirror is especially useful when the jewelry cabinet is configured to pivot on the stand so that the inside of jewelry cabinet can be easily accessed in one position and the mirror can be easily viewed in another position.

One embodiment of the invention is particularly useful where it is desirable to display and have easy access to a variety of different types of jewelry, such as rings, necklaces, bracelets, earrings, and many other jewelry items, where the cabinet has a number of jewelry storage elements that are capable of accommodating many different sizes of each of these items.

One embodiment of the invention is also particularly useful where it is desired to have flexibility in the location of the jewelry storage elements within a jewelry cabinet. As the present invention provides for at least one of the jewelry storage elements being relocatable within the jewelry cabinet, a user of the jewelry cabinet system can customize the jewelry cabinet system to meet their individual jewelry holding requirements and preferences.

One embodiment of the invention has also been found to be particularly advantageous where it is desired to have the option to either mount a jewelry storage cabinet on a wall or support the cabinet in a free standing holder or stand.

FIGS. 1-5 are views of a jewelry cabinet of the jewelry storage system of the present invention. FIG. 1 is a perspective view of the exterior of the jewelry cabinet. FIGS. 2-5 are front, right side, left side, and top views, respectively, of the jewelry cabinet shown in FIG. 1.

Referring to FIGS. 1-5, a jewelry cabinet 10 includes a box frame 12 that includes a top wall 14, a bottom wall 16, and two side walls 18, 20. A door 22 is connected to the box frame of the cabinet 10 by hinges 24 connected to side wall 18. The door 22 extends substantially from the top wall 14 to the bottom wall 16 of the box frame 12. Although the door 22 shown in FIG. 1 is about the same length as the box frame 12, the door 22 could be configured to be somewhat longer than the box frame 12, thereby creating a convenient overhanging element by which the door could be opened or closed. Alternatively, the door 22 could be somewhat shorter than the box frame 12.

Figure 2:
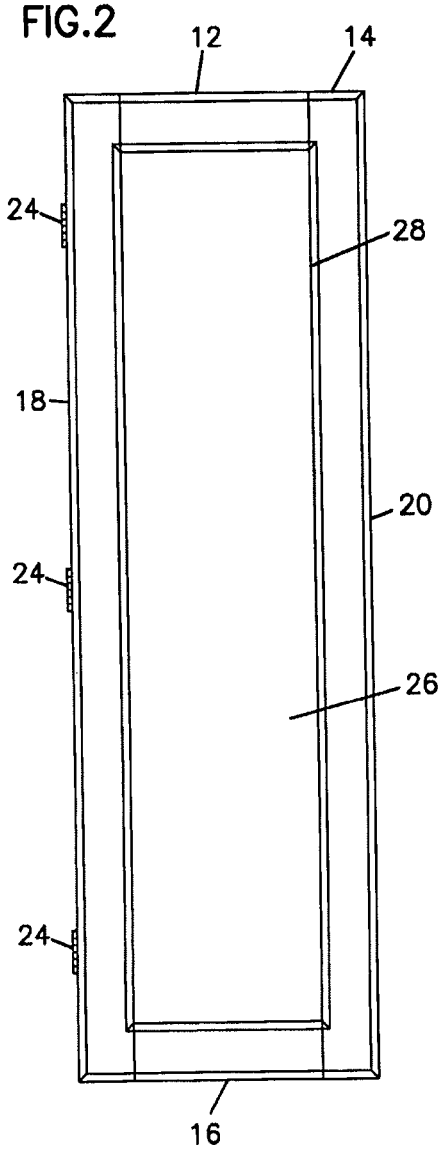
FIG. 2 is a front view of the jewelry cabinet of FIG. 1 in a closed position.
Figure 3:
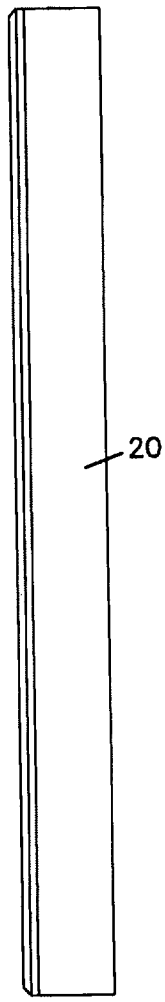
FIG. 3 is a right side view of the jewelry cabinet of FIG. 1 in a closed position.
Figure 4:
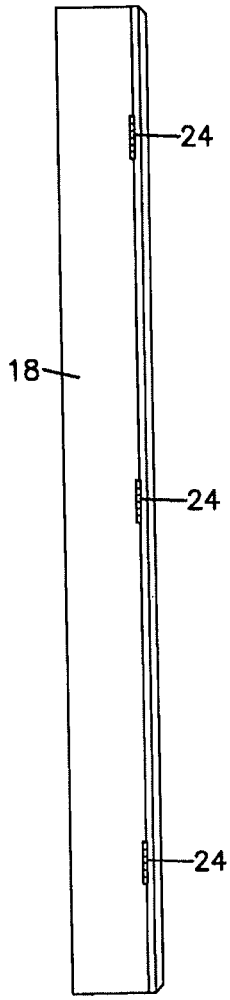
FIG. 4 is a left side view of the jewelry cabinet of FIG. 1 in a closed position.
Figure 5:
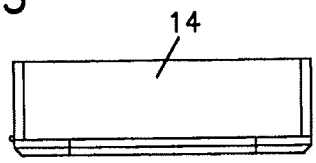
FIG. 5 is a top view of a the jewelry cabinet of FIG. 1 in a closed position.

The door 22 shown in FIGS. 1 and 2 is formed by a rectangular frame structure with a mirror 26 located in a central portion of the rectangular frame structure. Mirror 26 also has a mirror frame 28. The presence of mirror frame 28 is not required. However, if a mirror frame is included, it can be either a component of the mirror 26 which surrounds the mirrored surface, or it can be a raised or lowered surface of the door that the mirror 26 is inserted into or secured upon. The mirror 26 can be secured to the rectangular frame structure by a number of methods. For example, the mirror 26 can be secured to the door 22 by nails, screws, or glue. Of course, many other mechanisms are also possible for holding the mirror 26 in position within the door. In addition, the mirror need not be rectangular in shape or correspond to the shape of the box frame 12. The mirror could be oval, for example, and extend beyond the box frame 12. Alternative, the mirror could also be smaller than the box frame 12. The mirror can be formed of any desired shape.

Alternatively, the door 22 can be a solid rectangular door with a mirror secured to the exterior surface of the solid door. In such as case, the mirror may be secured to the exterior surface of a solid rectangular door by the same methods as noted above.

Figure 6:
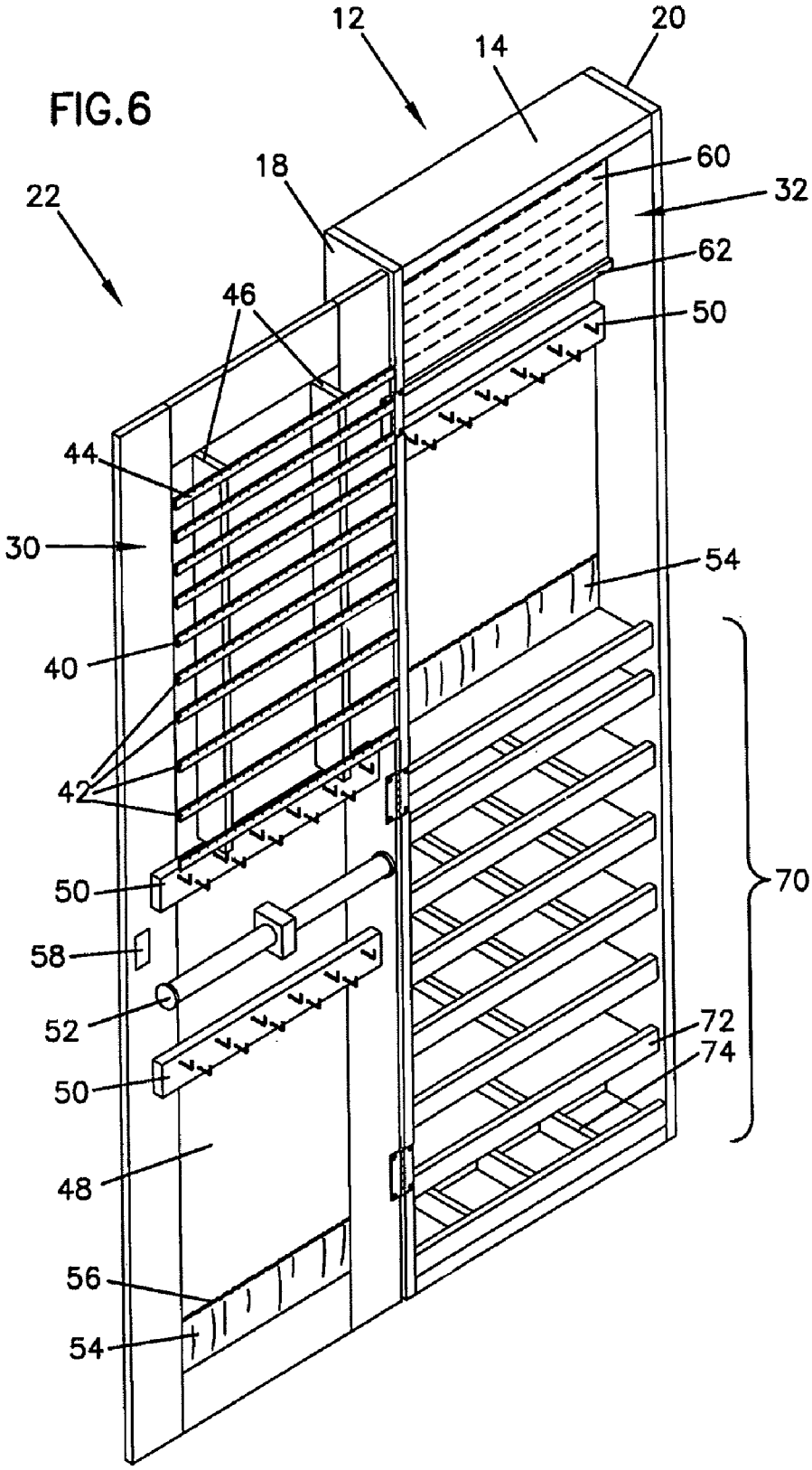
FIG. 6 is a perspective view of the jewelry cabinet of FIG. 1 in an open position that may be included in some embodiments of the jewelry cabinet.
Figure 7:
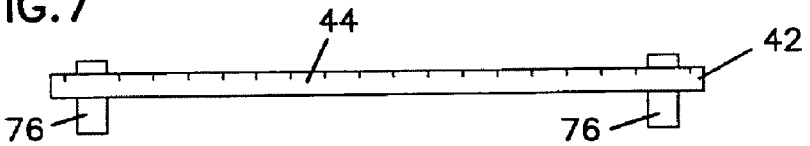
FIG. 7 is a front view of an earring bar that may be included in some embodiments of the jewelry cabinet.

FIG. 6 shows the interior of one embodiment of the jewelry cabinet 10, including the interior surface 30 of the door 22 and the interior 32 of the box frame 12. A number of jewelry storage elements are contained in the interior 30 of the door 22 and the interior 32 of the box frame 12. The jewelry storage elements are described in more detail below. For convenience, the same reference numbers will be used to refer to the same features when used in different embodiments.

Now referring to FIG. 6, the interior surface 30 of the door 22 includes an earring storage area 40. The earring storage area 40 may include one or more earring bars 42. Each earring bar 42 includes a number of slits 44 for receiving the post or other component of a pair of earrings. Earrings intended for pierced ears may be inserted or dropped into the slits 44. Clip earrings may be mounted directly on the earring bar 42. In one embodiment, ten earring bars are included in the earring storage area 40. However, many different numbers of earring bars may be provided in the earring storage area 40, such as one, two, five, twelve or fifteen.

Vertical elements 46 are connected to the earring bars 42. The vertical elements 46 attach to the door 22 and the earring bars 42 in turn attach to the vertical elements 46. The vertical elements 46 may attach to the interior surface 30 of the door 22 in many ways. For example, the vertical elements may be nailed, screwed, or glued to the interior 30 of the door 22. The interior surface 30 of the door 22 includes the wood frame and central area 48 surrounded by the wood frame. The central area 48 includes a cloth covering or other type of covering over the back of the mirror. In one embodiment, the cloth has anti-tarnish properties. Alternatively, a separate piece of wood, laminate, or other material may be positioned next to the back of the mirror. A cloth may be positioned in the central area 48 directly adjacent to the mirror or in addition to another piece of material. Alternatively, the back of the mirror could be exposed on the interior surface of the door. Alternatively, as noted above, the door 22 can be solid so that the back of the mirror 26 is not exposed by the interior surface 30 of the door 22.

Again referring to FIG. 6, below the earring storage area 40 there are two hook bars 50. The hook bars 50 have a number of hooks positioned on them to hold hanging items, such as bracelets, necklaces, or other hanging jewelry articles. Between the two hook bars 50, a bracelet storage area 52 is defined. The size of the bracelet storage area 52 may be selected to allow for convenient storage of bracelets.

The lower hook bar 50 on the inside surface 30 of door 22 is arranged to allow for storage of longer hanging items such as necklaces. This hook bar may be referred to a necklace bar, because the area beneath it is ample to support the hanging of necklaces. A pouch 54 is positioned at the bottom of the door's interior surface 30. The pouch 54 functions to contain very long necklaces that would otherwise extend below the bottom of the door 22. The pouch 54 preferably includes an elastic element 56 at its top edge to neatly contain the necklace portions.

The door interior 30 may also include a door securing element 58. Alternatively, a door securing element is not required for the cabinet 10. The door securing element 58 could be a magnet that holds the door shut without locking it. Alternatively, the door securing element 58 could be a latching or locking-type mechanism, such as a standard key-operated locking mechanism.

FIG. 6 also shows the interior 32 of the box frame 12. A ring storage area 60 includes a foam ring section with slits 62 for holding rings. The ring storage area 60 is defined between a top wall 14 of the box frame 12 and a divider 64. On the sides, the ring storage area is bordered by the two side walls 18, 20 of the box frame 12. The ring area may be about 7 inches tall including a foam section about ¾ inch thick. The foam section may be secured in the box frame using glue.

Below the divider 64, another hook bar 50 is positioned including a number of hooks for hanging jewelry articles, such as necklaces. Another pouch 54 is located below the hook bar 50 that is located on interior 32 of the box frame 12.

Below the hook bar 50 and pouch 54, a shelf storage area 70 is defined and includes a number of shelves 72. In one embodiment, the shelves may be provided with shelf dividers 74 for conveniently dividing the top surface area on the shelves 72 into individual storage areas for jewelry articles. The dividers 74 may be movable and/or removable.

Figure 8:
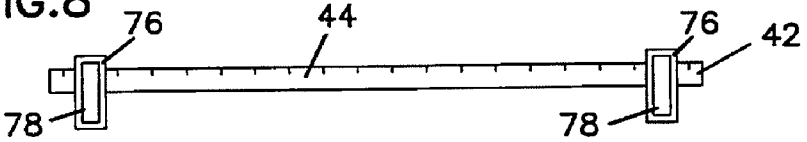
FIG. 8 is a back view of the earring bar of FIG. 7.
Figure 9:
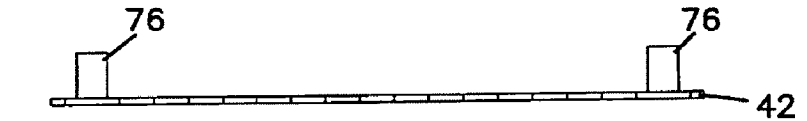
FIG. 9 is a top view of the earring bar of FIG. 7.
Figure 10:
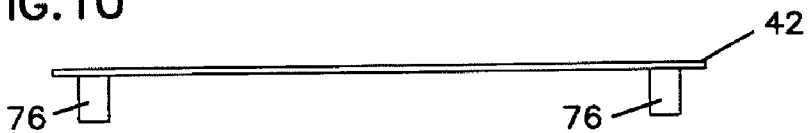
FIG. 10 is a bottom view of the earring bar of FIG. 7.
Figure 11:
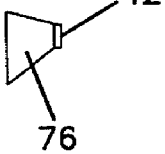
FIG. 11 is a side view of the earring bar of FIG. 7.

In one embodiment, the earring bar is about 12 inches wide, about ⅛ inch thick and about 7⁄16 inches tall. The slits 44 for holding earrings in the earring bar 42 may be about ⅛ inch deep and may be spaced apart by about ½ inch. Many different configurations are possible for the earring bar, including different shapes, and many different dimensions for the depth of the slits, the spacing of the slits, and the dimensions of the earring bar. The earring bar 42 can be attached to vertical elements 46 as shown in FIG. 6. Alternatively, the earring bar 42 can be attached to a mounting element 76, as shown in FIGS. 7-13, which is in turn attached to the jewelry cabinet. As seen in FIGS. 8 and 13, a rear side of the mounting element 76 can contain attachment devices 78.

The attachment devices 78 can be permanent. Alternatively, they can be configured so that the jewelry elements are moveable and may be individually positioned by a user on an interior surface of a door of the cabinet or within the box frame of the cabinet so that the user may create a jewelry-organizing scheme perfectly suited to her individual collection. The movable elements may attach to the jewelry cabinet in many different ways. For example, the attachment device 78 could be magnets that are attracted to a metal material in the mirror, or metal elements that attach to a magnetic material mounted on the cabinet. Alternatively, hook and loop fasteners may attach to a cloth to provide movable storage elements. In another alternative, adhesive could be used to position the movable elements. In a further alternative, pegs or screws could be used on a pegboard type configuration within the jewelry cabinet.

Referring now to FIGS. 14 and 15, the bracelet bar 52 is shown in more detail. The bracelet bar 52 includes a mounting block 80, a first pole 82 and second pole 84. First and second poles 82, 84 can be constructed of one piece of material or they may be two separate elements. The first and second poles 82, 84 are cylindrical structures that may receive hanging bracelets. Each pole includes a slightly larger end portion 86, 88. The mounting block 80 is preferably located at a central location relative to the sides of the door 22. With this arrangement, bracelets can be secured or removed from the bracelet bar 52 via either end of the bracelet bar 52. However, it is also possible for the mounting block 80 to be located in many different locations. The mounting block 80 can be mounted in any number of ways, including all of those ways as mentioned above with respect to the earring bar 42.

The use of the bracelet bar 52 is not limited to hanging bracelets. The bracelet bar may hold necklaces, scarves, and many other items. It is referred to as a bracelet bar for convenience only.

Figure 16:
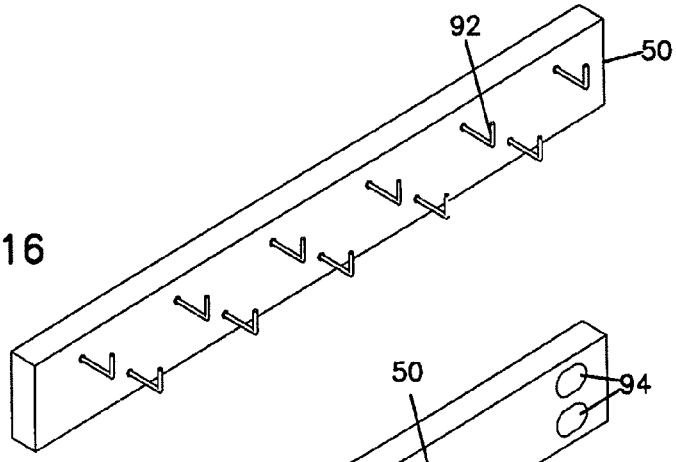
FIG. 16 is a front perspective view of a hook bar that may be included in some embodiments of the jewelry cabinet.
Figure 17:
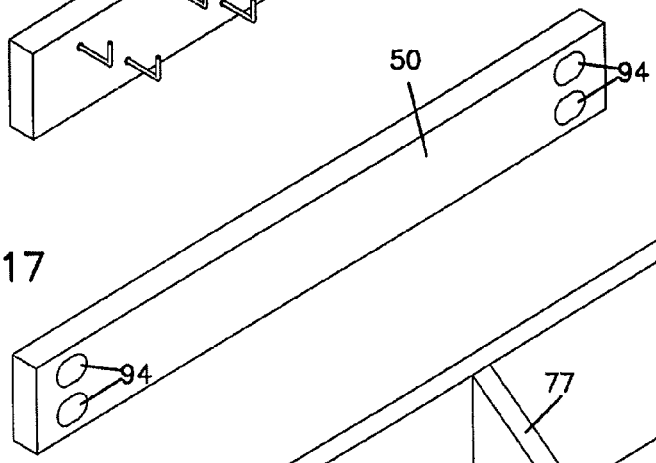
FIG. 17 is a rear perspective view of the hook bar of FIG. 16.

Referring now to FIGS. 16 and 17, the hook bar 50 is shown in more detail. Hook bar 50 may include a number of hooks 92. FIG. 16 shows a hook bar 50 with 11 hooks. However, the hook bar may include any number of hooks 92. The number of hooks can be between 2 and 20, or 5 and 15, or more preferably around 11. In addition, the hooks 92 are preferably staggered higher and lower to facilitate easy access to jewelry items that are placed on the hooks 92. The hook bar 50 can be mounted in any number of ways can be mounted in any number of ways, including all of those ways as mentioned above with respect to the earring bar 42. Alternatively, the hooks could simply be connected to the cabinet itself and not to a separate element first. It should be understood that the term hook bar encompasses a structure where hooks that are attached to a separate element and then attached to the cabinet as well as hooks that are attached directly to the cabinet without a separate element.

Figure 18:
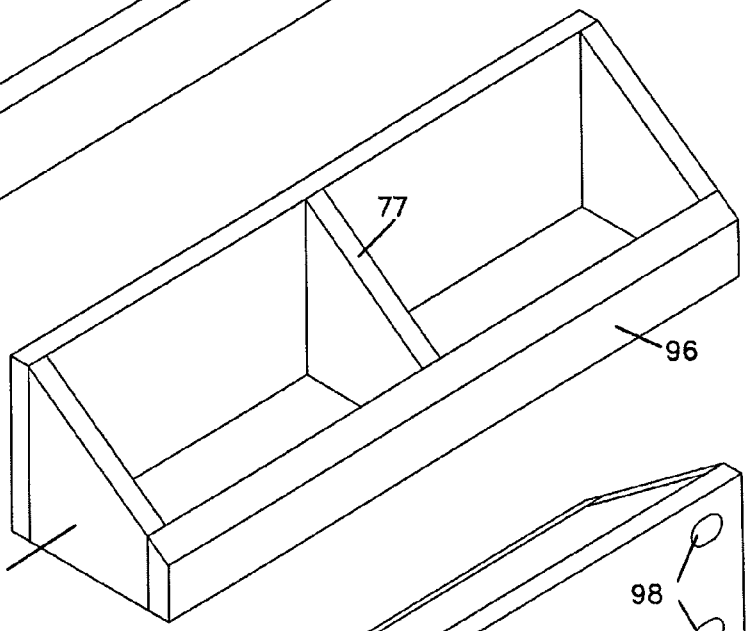
FIG. 18 is a front perspective view of a shelf of an embodiment of the present invention.
Figure 19:
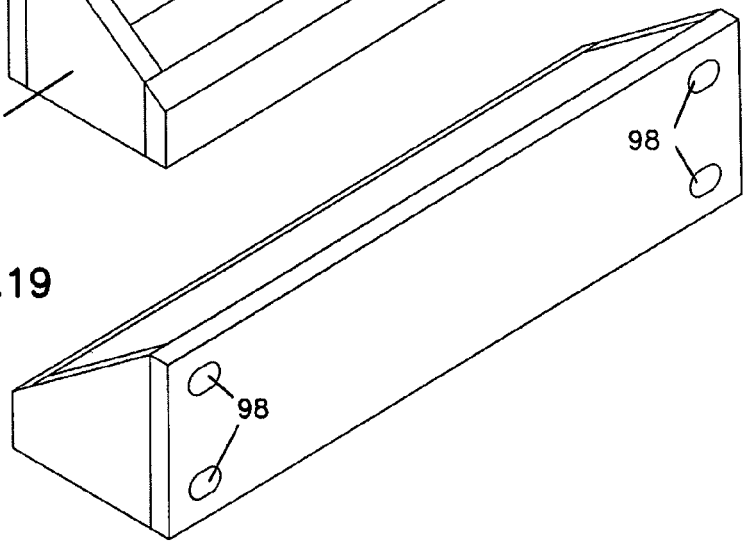
FIG. 19 is a rear perspective view of a shelf shown in FIG. 18.

FIGS. 18 and 19 show an example of a side-braced shelf 75. The side-braced shelf 75 can have angled sides, such as that shown in FIGS. 18 and 19. Alternatively, the shelf 75 can be need not have angled sides. Alternatively, a shelf does not need to have sides at all, such as the shelf 72 shown in FIG. 6. Braced-shelf divider 77, much like divider 74, can be used to conveniently divide the top surface area on the shelf 72 into individual storage areas for jewelry articles. The braced-shelf divider 77 may be movable and/or removable. More than one divider 77 may be positioned within the shelf 77.

The shelf preferably has a raised front wall member 96 that extends upward from a front surface of the shelf to hold jewelry articles securely on the shelf 72. The shelves 72 can be mounted in any number of ways can be mounted in any number of ways, including all of those ways as mentioned above with respect to the earring bar 42.

The embodiment shown may have many different dimensions. For example, the height of the unit could range from 2 feet to 6 feet, or 3 feet to 5 feet, or about 4 feet. The width of the unit could range from about 6 inches to about 2 feet or about 1 foot to 18 inches or about 15 inches. The depth of the unit could range from about 2 inches to about 6 inches or about 4 inches. The top and bottom frame members may be about ¾ inch thick. The left and right side frame members may be about ½ inch thick. The frame surrounding the mirror may be about 2¼ inches from the edge of the mirror to the outside edge of the frame.

Alternatively, the cabinet can be much smaller than identified above. For example, the height of the unit can be between 15 inches and 24 inches in height, or between 18 inches and 22 inches, or about 20 inches. The depth and width of such a unit would be substantially the same as that indicated above with the larger unit. Of course, the smaller dimension unit would have fewer jewelry storage items contained within it. However, the smaller dimension unit could contain any arrangement of the various jewelry storage elements identified above. For example, it could contain one necklace hook bar, a pouch below the necklace hook bar, a ring area, a shelf at bottom of the box frame, an earring bar, a bracelet bar, and an additional hook bar.

Within the box frame 12 and on the door interior 30, the ring storage area, bracelet storage area, necklace storage areas and shelf areas may be configured in many different ways. Alternatively, the storage components may be capable of repositioning according to the preferences of a specific user. Features for accomplishing a re-arrangeable interior will be discussed further herein with reference to additional figures.

In the embodiment illustrated in FIG. 6, one example of an arrangement of jewelry article storage components is shown. In this particular example, the earring bars 42 are organized to be closer together at the top of the earring storage area and farther apart toward the bottom of the earring storage area. As a result, larger earrings can be accommodated in the bottom earring areas. The first three earring bars are spaced about 1½ inches apart. The next three earring bars are spaced about 1¾ inches apart. The remaining four earring bars are spaced about 2¼ inches apart. In one embodiment, the fabric pocket or pouch 54 is about 2½ inches long on both the door and in the box frame. This feature could encompass many different sizes. The dividers 64 used in the box frame 12 may be about ⅜ inch thick and 1 inch tall from the back wall of the box frame to the front of the divider.

The necklace storage area on the box frame 12 may be about 15 inches tall. The shelf components 72 may be spaced about 3¼ inches apart from each other. The necklace bar 50 may be a wood strip about 1½ inches wide having 11 hooks spaced 1 inch apart at staggered heights.

The spacing disclosed above is that of a preferred embodiment; however, it should be understood that any spacing of the jewelry storage elements could accomplish the objectives of the present invention.

Some or all of the interior surfaces of the jewelry cabinet may be covered with an anti-tarnish cloth such as a polish cloth available from Fifield Inc. of Hingham, Mass. In addition, any of the interior or exterior surfaces of the jewelry cabinet can be covered with a decorative fabric or other material, such as flocked kraft paper, if so desired. The cabinet is preferably constructed mainly of wood, but many other materials may be used, such as plastic or metal materials. The jewelry storage elements 42, 50, 52, 54, 60, and 72 may be constructed in many different ways, one example of which is illustrated in the drawings. The components may be made of wood, plastic, metal, or many different materials. The attachment devices may be many different structures, as discussed previously. The number of attachment devices may vary significantly from one attachment device to four or more attachment devices. The attachment devices will be configured to support the movable jewelry storage element and jewelry that may be stored on it.

Figure 20:
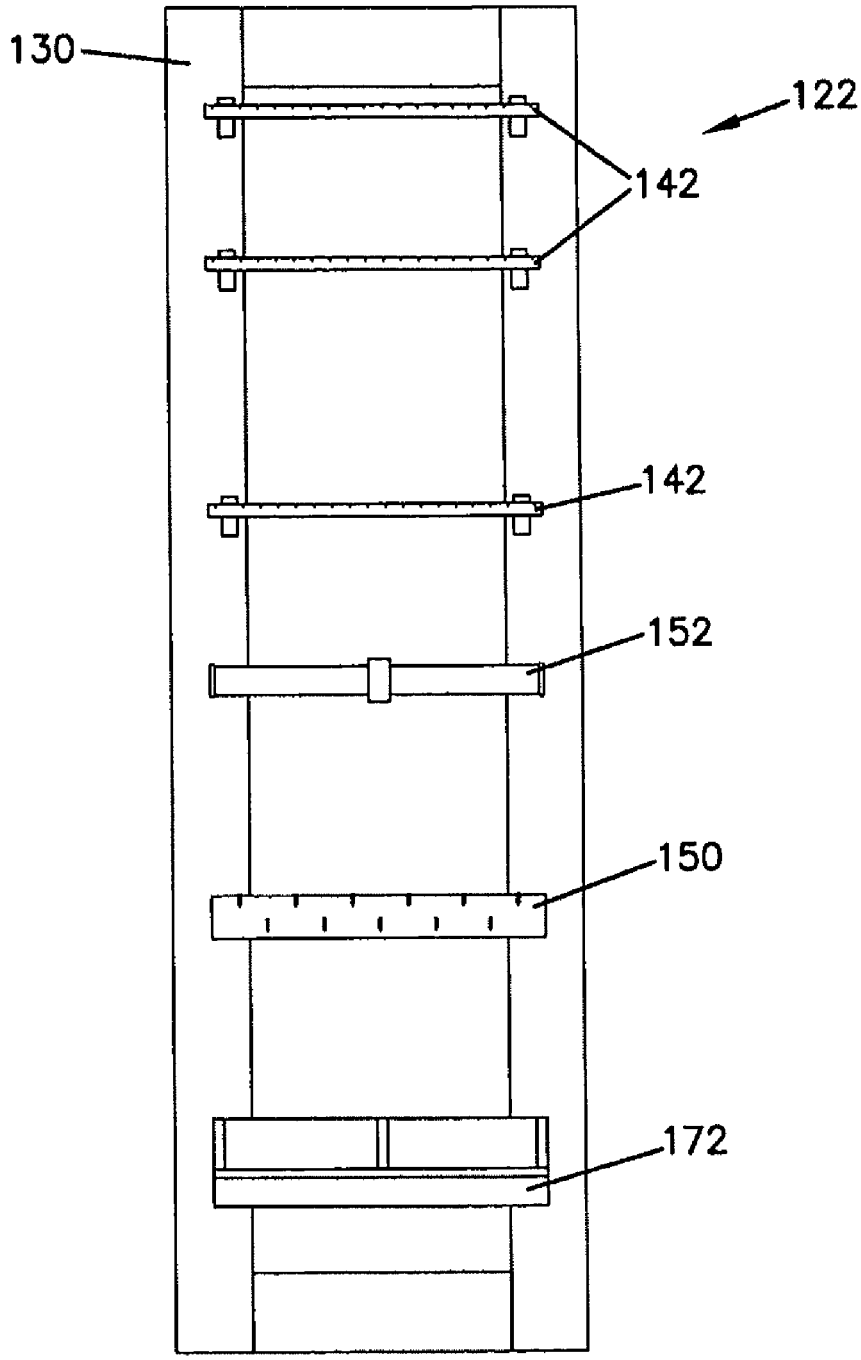
FIG. 20 is a front view of a portion of a jewelry cabinet that has movable jewelry storage elements.

FIG. 20 shows a front view of another alternative embodiment of a jewelry cabinet of the present invention. An interior surface 130 of a door 122 is provided. Movable elements are positioned on the interior surface 130 of the door 122. The movable elements may be arranged in a variety of ways and different specific movable elements may be selected by a user. In the particular embodiment illustrated in FIG. 20, the interior area includes earring bars 142, bracelet bar 152, hook bar 150 and shelf 172. These movable elements may be attached to the door 122 in a variety of ways. For example, as shown in FIG. 20, the movable elements may include hook and loop fasteners that attach to a material within the interior area 130.

Alternatively, the door 190 may include a mirror on its exterior side (not shown) and the movable elements may incorporate magnets, as attachment devices, to stick to the back of the mirror. The mirror surface may be exposed within the interior area 130 or a cloth may cover the mirror back. Many other types of covering may be used over the mirror back within the interior area 130 also. In a further alternative, the interior area 130 may include openings for receiving pegs or screws. The ability to move the movable jewelry storage elements provides flexibility to the user in arranging the elements to best store her jewelry collection. It should be understood that the mirror may be included with any of the embodiments disclosed herein, or the mirror may be excluded from any of the embodiments disclosed herein.

Figure 21:
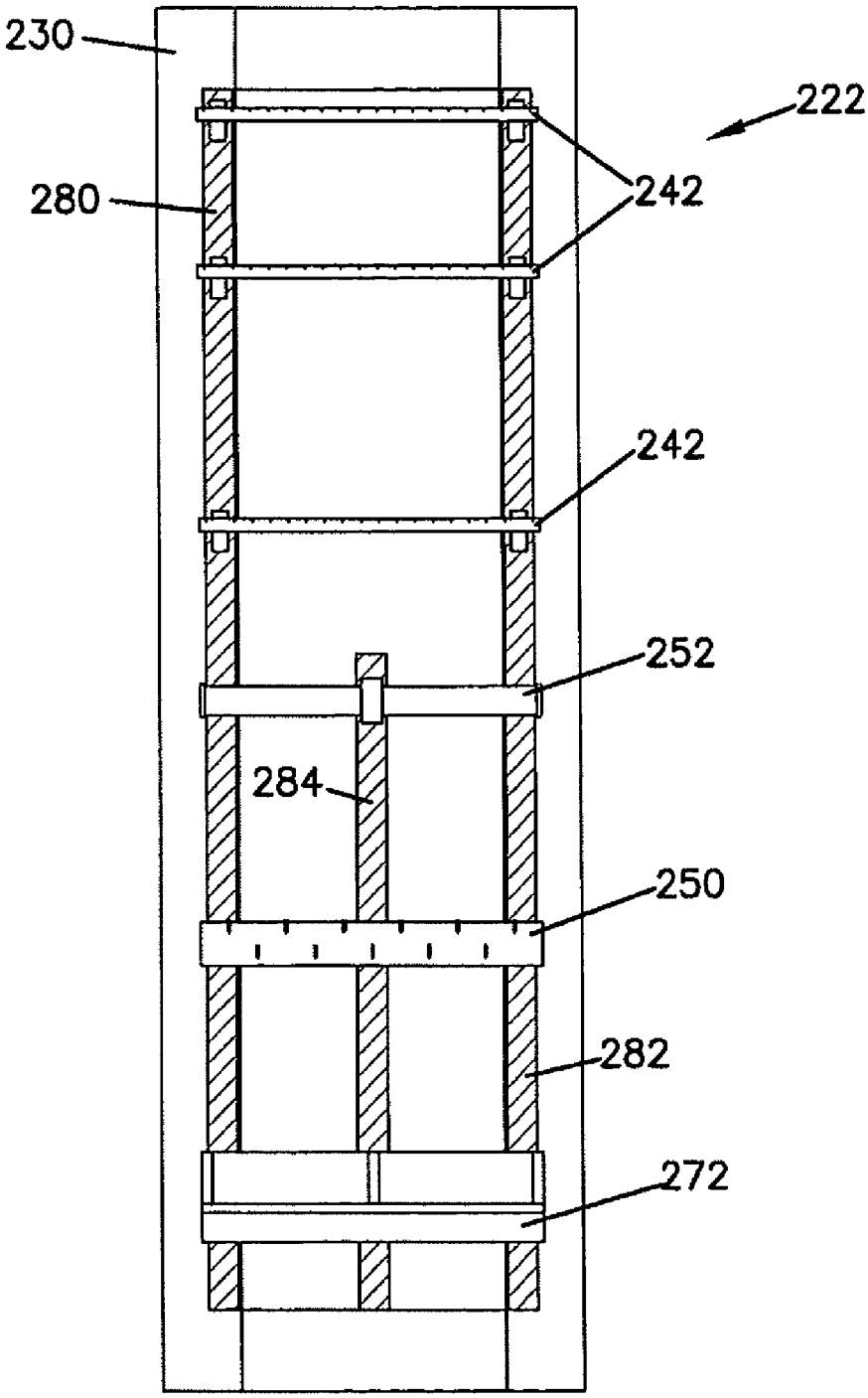
FIG. 21 is a front view of a portion of another jewelry cabinet that has movable jewelry storage elements.

FIG. 21 shows an alternative embodiment of a door 222 including several movable elements, including earring bars 242, bracelet bar 252, hook bar 250 and shelf 272. Within an interior area 230 of the door 222, attachment strips are positioned to facilitate the attachment of movable elements. A first attachment strip 280 and a second attachment strip 282 run the length of the interior area 230 near the sides of that area. A third attachment strip 284 is present near the center of the interior area 230. The third attachment strip 284 would function to secure a center mounted bracelet bar 252 as well as to possibly provide additional strength where needed on other jewelry storage elements that may be heavy, such as the shelf 272. Attachment strips within the interior area may be configured in many different arrangements. In the arrangement illustrated in FIG. 21, the third attachment strip 284 does not extend the entire length of the interior area. Instead, the third attachment strip 284 extends from near the bottom of the interior area to near the middle of the interior area.

The attachment strips are used to facilitate the attachment of the movable elements. The attachment strips interact with the attachment devices (or mounting pads) on the movable elements. One example of an attachment arrangement that may be used is metal or magnet material as the attachment strips to interface with metal or magnetic material on the movable elements. Another alternative is to use hook and loop fasteners on the attachment strips and mounting pad. A further alternative would be to use adhesive material and an adhesive receiving material on the attachment strips and removable pads. Yet another alternative involves pegs and openings to receive the pegs for adjusting the height and position of the movable elements.

The use of movable elements within a jewelry cabinet allows the user to cater the cabinet to her collection. For example, if a particular user has more earrings than are accommodated on three earring bars, she can include more earring bars in her cabinet. Accordingly, the specific movable elements may be selected and positioned according to the users preference.

Figure 22:
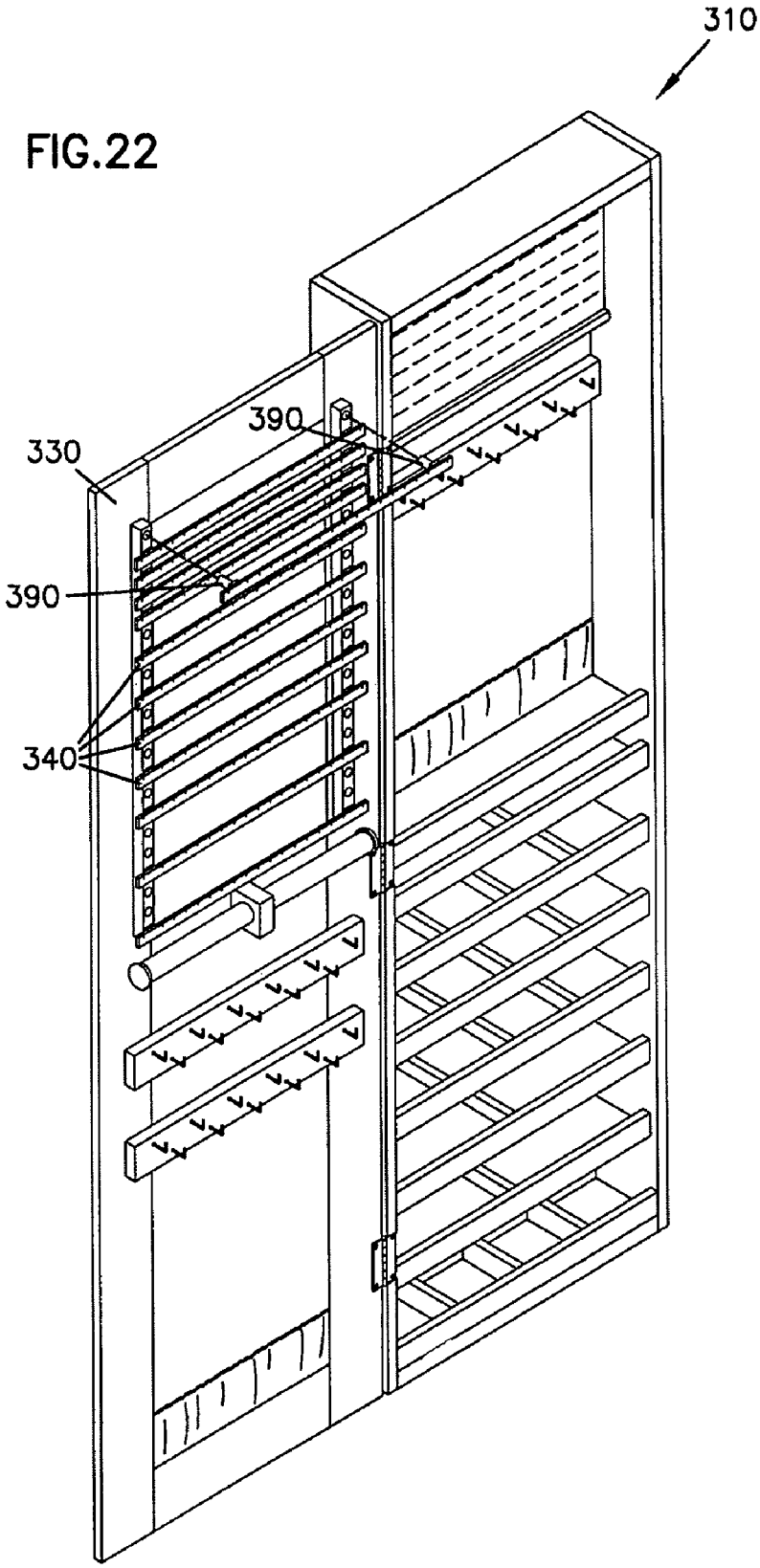
FIG. 22 is a front perspective view of yet another jewelry cabinet that has movable jewelry storage elements.

FIG. 22 shows another alternative embodiment of a door 322 including moveable earring bars 342. The attachment devices on the back of the earring bars 340 include pegs 390. The pegs 390 fit into openings on the interior 330 of the door 322. In this manner, the user can decide how many earring bars 342 will be in the jewelry cabinet and where those earring bars 342 will be located. The rest of the elements shown in the cabinet are the same as those described in the first embodiment above.

It is understood that the jewelry storage elements can be configured in a number of different ways. In addition, some of the jewelry storage elements can be permanently secured to the cabinet and some can be removable from or moveable within the cabinet. For example, the cabinet 10 shown in FIG. 6 could be provided with just 1, 2, 3, or any number of movable elements with the remainder of the jewelry storage elements affixed permanently to the jewelry cabinet 10. For example, the interior components could be identical to those shown in FIG. 6 with a movable bracelet bar attached below hook bar 50.

Another alternative arrangement of interior components of a cabinet would involve placing the door elements from FIG. 6 in the box frame and placing the box frame elements on the door. These components may be reversed or certain specific components may be reversed in their placement on the door or in the box frame. For example, the box frame may include several earring bars, two hook bars and a pouch. The door may include a ring storage foam structure, a hook bar, and one or more shelves. A bracelet bar may be positioned on either the door or in the box frame in this version.

Mounting Structures

Figure 23:
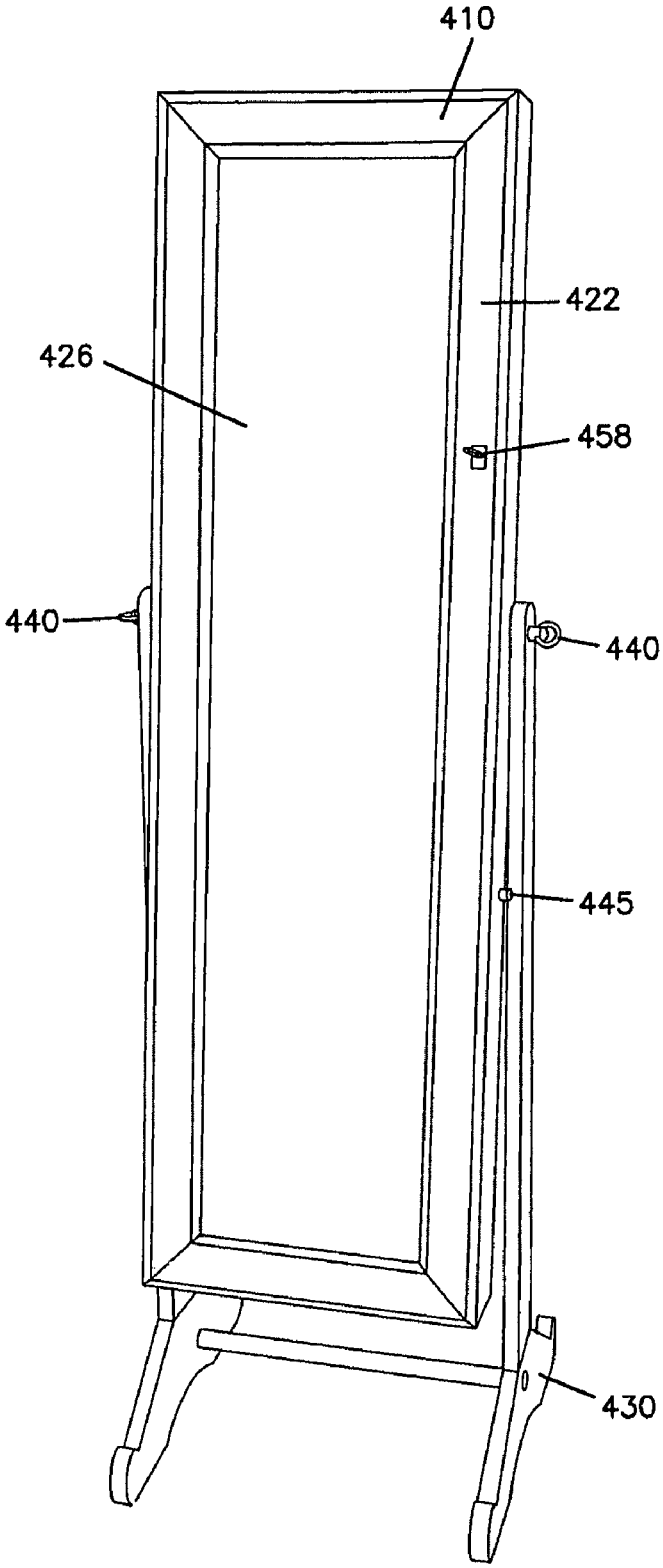
FIG. 23 is a front perspective view of a jewelry cabinet system of the present invention.
Figure 24:
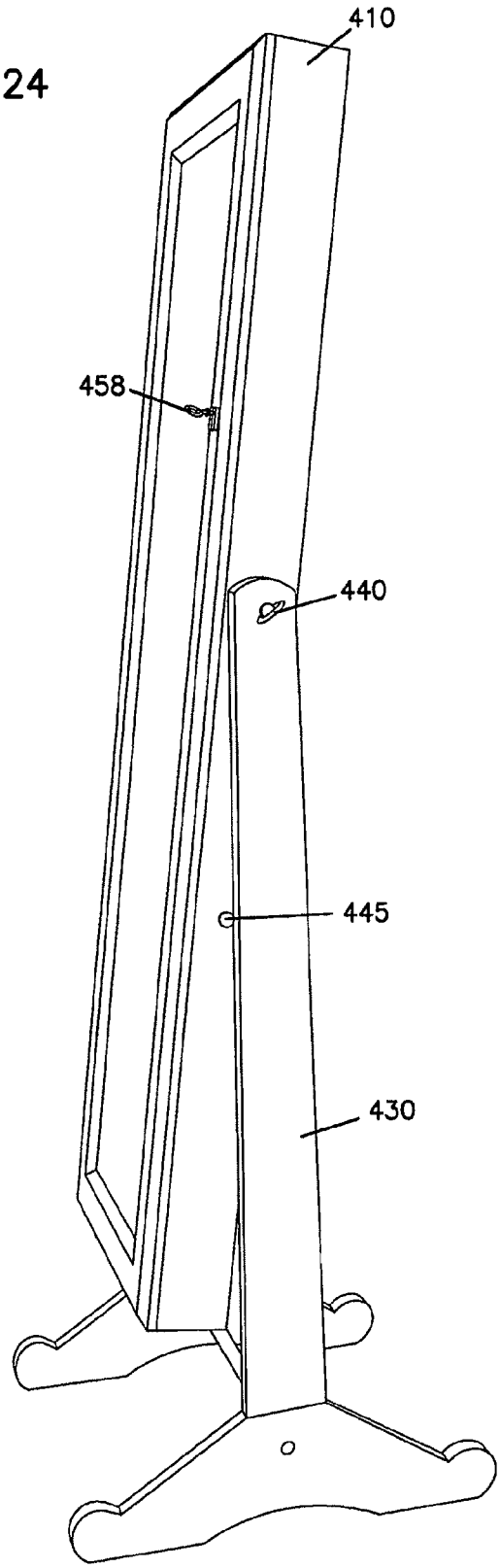
FIG. 24 is side perspective view of the jewelry cabinet system shown in FIG. 23.

FIGS. 23 and 24 show an embodiment of the jewelry storage system of the present invention. A jewelry cabinet 410 is received by a stand 430. The cabinet 410 is secured to the stand 430 via side screws 440, which are on each side of the stand 430. The side screws 440 also form a fulcrum about which the cabinet 410 can rotate if the side screws 440 are loosened.

In this manner, the cabinet 410 can rotate so that it forms various angles from the horizontal. For example, in a substantially vertical position, the cabinet 410 forms an angle of about 90 degrees from the horizontal. The cabinet 410 can be rotated, however, so that the back wall of the cabinet forms an angle with the horizontal that is less than 90 degrees. Thus, it is possible to rotate the cabinet 410 backwards and forwards about the fulcrum created by the side screws 440. It is possible to adjust the cabinet angle and simply tighten the side screws 440 when the cabinet 410 is at the desired angle.

Preferably, however, there is an additional mechanism for adjusting the angle of the cabinet 410. Referring again to FIGS. 23 and 24, angle adjusting element 445 is located on the side of the cabinet 410 so that the angle of the cabinet 410 can be easily altered. Angle adjusting element 445 can be a peg placed in an opening on the side of the cabinet 410. The cabinet 410 can have several openings spaced along the side of the cabinet 410, so that a user can adjust the angle of the cabinet 410 by simply placing a peg in one of the openings. If the peg is placed an opening closer to the back of the cabinet 410, for example, the back of the cabinet 410 will form a smaller angle with the horizontal. A smaller angle will likely be preferable when a user wishes to use a mirrored surface 426 on the outside of the jewelry storage system as a full-length mirror. However, when the user wishes to access jewelry held inside the jewelry cabinet 410, it will likely be preferable to place the jewelry cabinet 410 in a substantially upright, or vertical, position. Upright, in the context of this invention, means that a top wall of the box frame is higher than a bottom wall. It is most preferable that the jewelry cabinet 410 be capable of positioned in a fully upright position, where the angle it forms with the horizontal is substantially 90 degrees. Many alternatives are possible for the angle adjusting element 445. For example, there may be more than one angle adjusting element 445. For example, there may be one on both sides of the cabinet.

Figure 25:
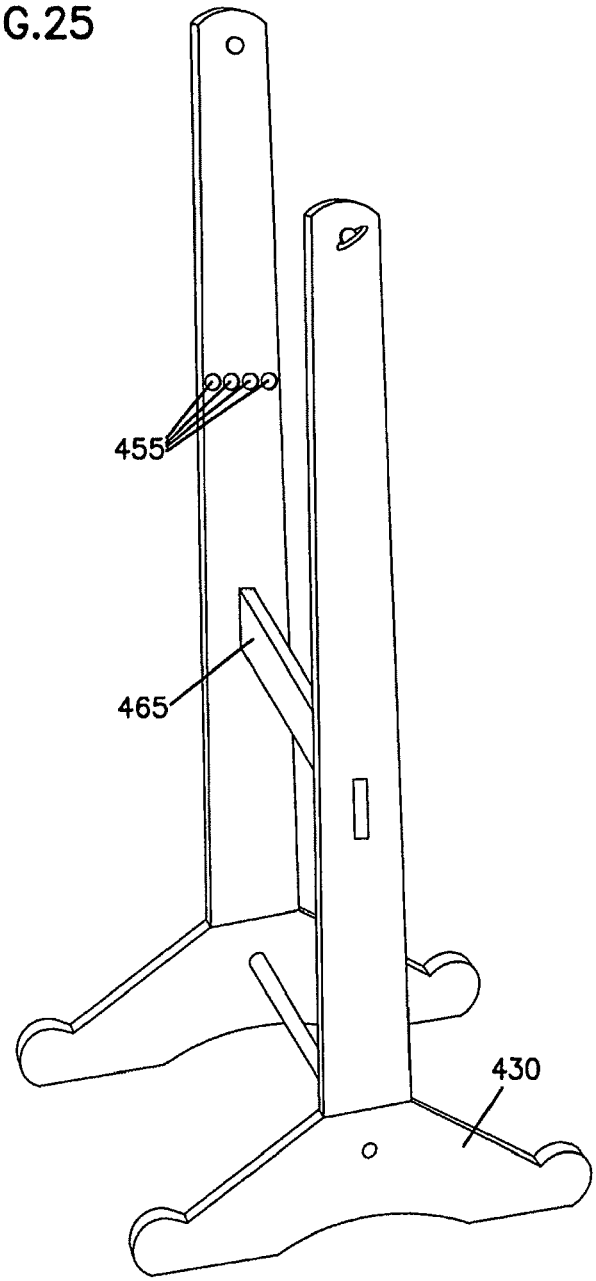
FIG. 25 is a perspective view of a stand described in one embodiment of the present invention.
Figure 26:
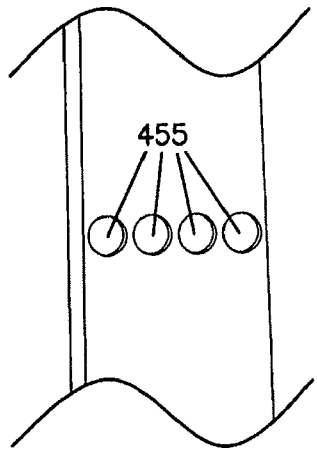
FIG. 26 is a partial side view of the stand shown in FIG. 24.

In another embodiment, the pegs may be placed in openings 455 on the inside surface of the stand 430, rather than in openings on the side of the cabinet. This arrangement has the advantage of the pegs being less visible from the outside since they would be located behind the cabinet. FIGS. 25 and 26 show an embodiment of the jewelry storage where openings 455 are located on an inside surface of the stand 430. FIGS. 25 and 26 show four openings 455 in which a peg can be placed to facilitate adjustment of the mirror. The openings 455 may be holes that extend through the side of the stand 430, or they may be notches which only partially extend into the side of the stand 430.

Alternatively, other methods for adjusting the angle can be used. For example, another method of adjusting the angle could include the use of a brace that is attached to the back of the jewelry cabinet. The brace could extend outward from the cabinet and rest on the stand, much like an arm brace of a picture frame for a desk. When the brace is extended, the cabinet would be supported at an angled position. These are just a few of the many angle adjusting methods that are contemplated by the present invention.

If the peg and opening method is used as the method of adjusting the angle of the cabinet, the openings can be placed at various locations on the stand or cabinet. For example, the openings could be spaced horizontally ¼ to ½ inch apart on the side of the cabinet. Alternatively, the openings could be spaced vertically apart. The cabinet can be configured such that when no peg is placed in an opening, the cabinet rests at about 90 degrees from the horizontal. Alternatively, the upright (90 degree) position can be secured by a peg or some other bracing mechanism. For example, the cabinet can be supported by a horizontal brace 465. The horizontal brace 465 show in FIG. 25 is centered in the stand. Accordingly, when the cabinet rests on the horizontal brace 465, without any peg or other angle adjustment, the angle of the back of the cabinet with the ground is just less than 90 degrees. Ninety degrees or just less than 90 degrees is the preferred angle for accessing jewelry items inside the cabinet, although, of course, jewelry items can still be accessed when the cabinet is configured at some other angle.

The cabinet can be configured so that it can form any number of angles. For example, if the cabinet is to be adjusted by the side screws only, it can form any angle with the horizontal that is desired. If discrete angle adjusting elements, such as pegs, are used then it is still possible to form a number of different angles, such as 2 to 10 different angles, or 3 to 5 different angles. These angles can vary from about 45 to 90 degrees, or, more preferably, from about 60 to 90 degrees. For example, the cabinet can be configured so that it is adjustable in four positions, such as 50, 60, 70, and 80 degrees, in addition to the vertical (90 degree) position.

It has been described above that a door securing element can be used to secure the door in a closed position. FIGS. 23 and 24 show a latching mechanism 458 that can be used to secure the door 422 of the cabinet 410 in the closed position. The latching mechanism 458 can be, for example, a slide bolt mechanism or a simple latching mechanism. Alternatively, the latching mechanism 458 can be a lock and key type system. Latching mechanism 458 can also be used as a handle to open the door 422 of the cabinet 410. Alternatively, any number of different handles, or no handle at all, can be used with the present invention.

The stand 430 that is shown includes two vertical elements, a cross bar between those two elements, and horizontal brace 465. However, it will be understood that any number of different structures could be utilized for the stand. For example, the cross bar can be included without the horizontal brace 465, or vice versa.

Figure 27:
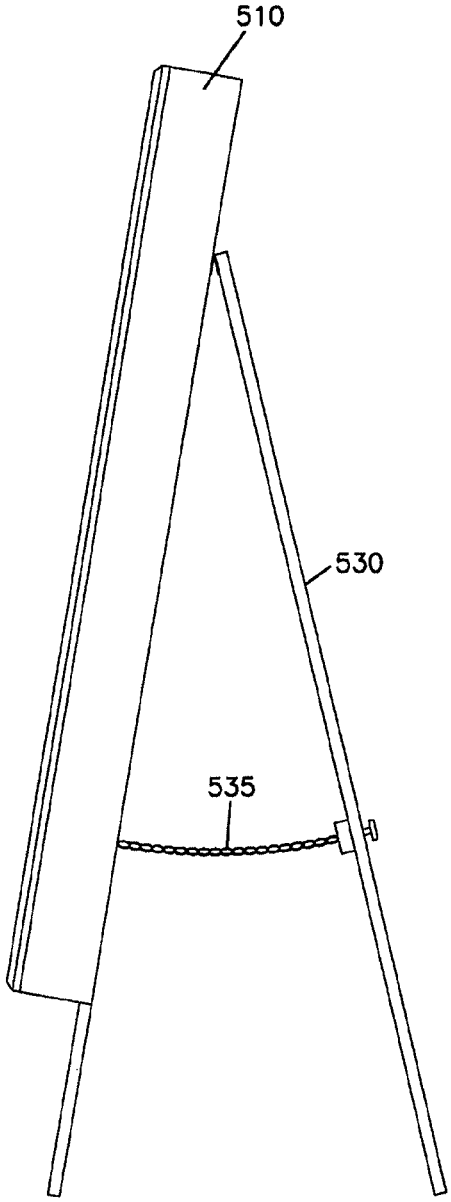
FIG. 27 is a side view of a stand described in one embodiment of the present invention.
Figure 28:
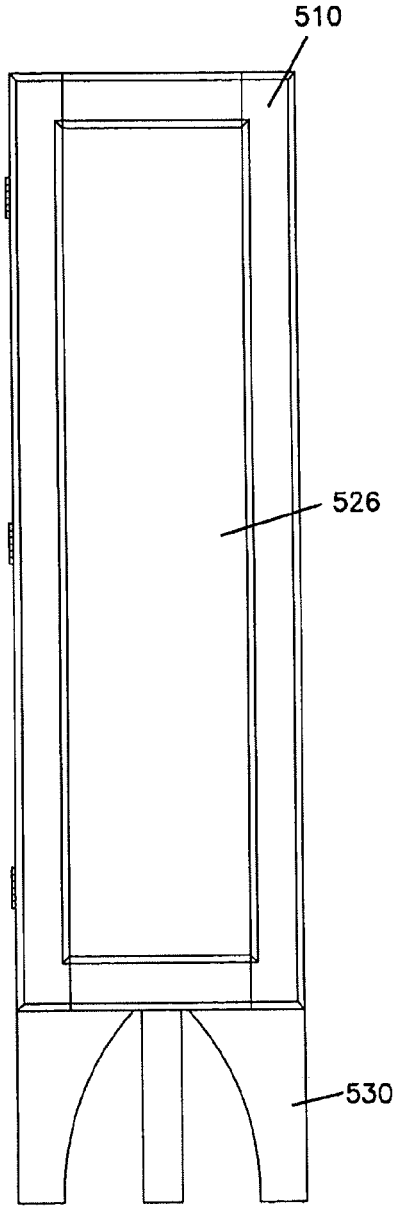
FIG. 28 is a front view of the stand shown in FIG. 27.
Figure 29:
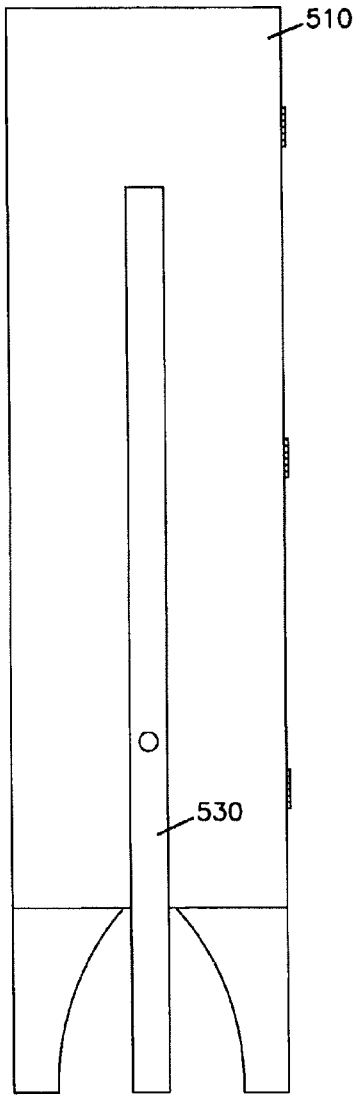
FIG. 29 is a rear view of the stand shown in FIG. 27.

Alternatively, the stand can be designed similar to an artist's easel. FIGS. 27-29 show an embodiment where a cabinet 510 is attached to two vertical legs and a rear leg 530. The rear leg 530 can be attached to the cabinet 510, having a mirror 526, by a hinged point at the top of the rear leg 530 and by a flexible, or adjustable, member 535. This member 535 can be, for example, a chain or rope-like structure. A benefit of such a stand and angle adjustment system is that the cabinet system can achieve any angle that is desired. In other words, the angle of the cabinet system can be varied continuously.

Figure 30:
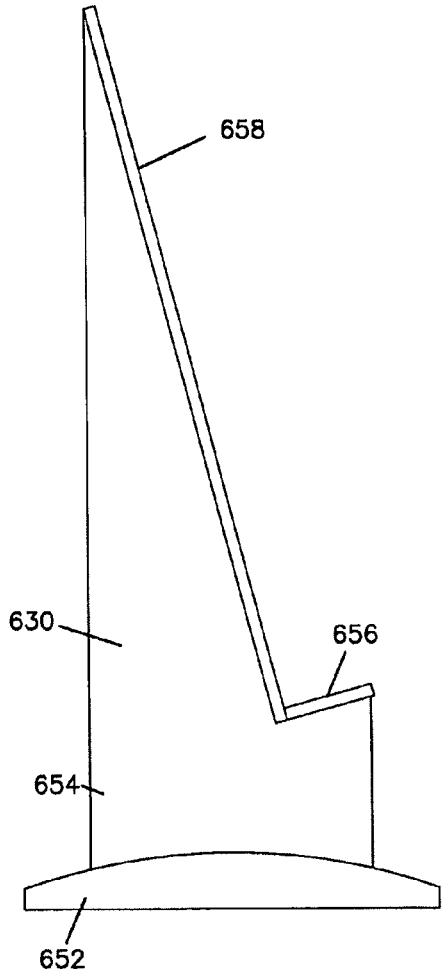
FIG. 30 is a side view of a stand described in one embodiment of the present invention.
Figure 31:
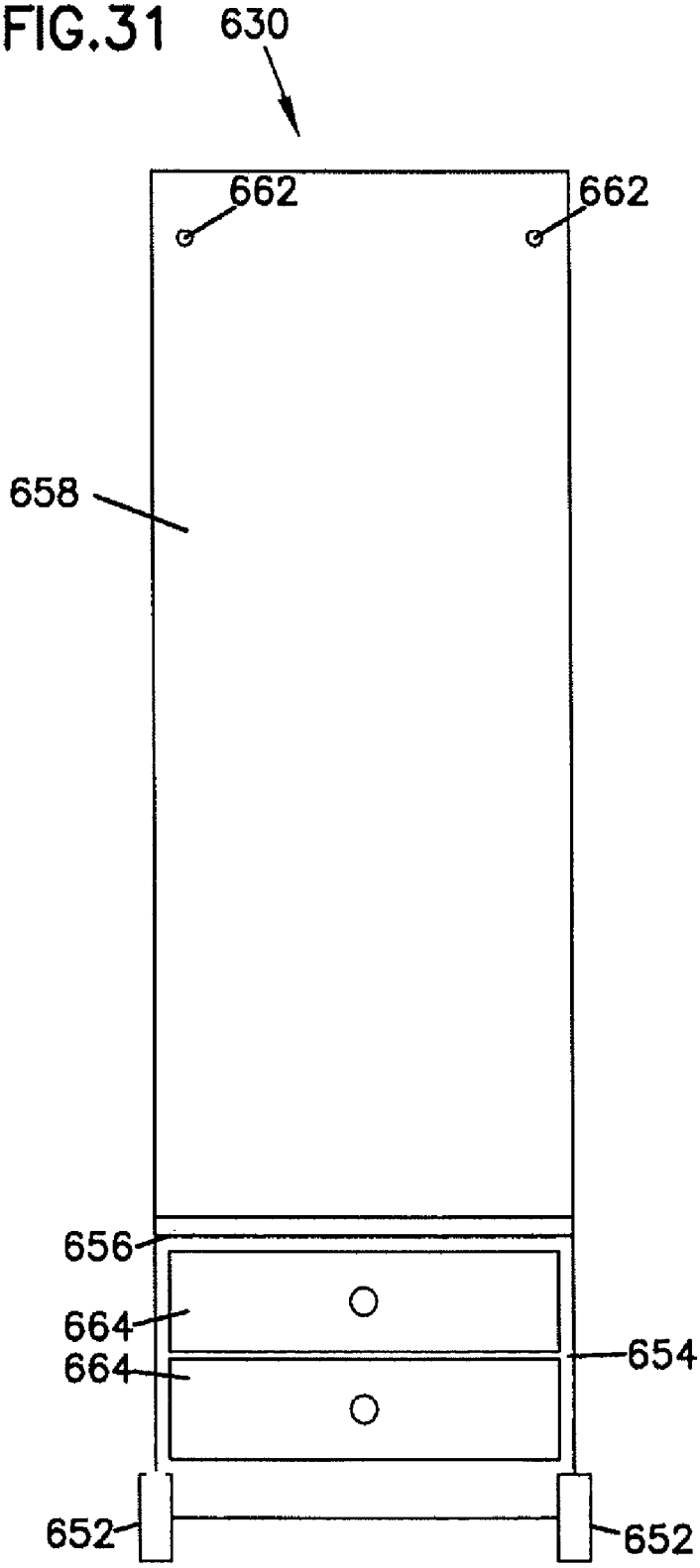
FIG. 31 is a front view of the stand shown in FIG. 30.

Alternatively, the stand may be more of a cradle that supports the bottom of a cabinet and back of the cabinet. An alternative stand 630 is illustrated in a side and front view in FIGS. 30 and 31, respectively. The stand 630 includes base member 652 and a vertical body 654. A cradle 656 is supported by the vertical body 654. The cradle includes a first planar member 656 for supporting the bottom of a cabinet and a second planar member 658 for supporting the back of a cabinet. The second planar member 658 includes openings 662 for accommodating a nail, screw, or other fastener for securing the stand 630 to the cabinet. The vertical body 654 may include drawers 664 for additional storage space. Alternatively, the planar members 656, 658 may include a supporting but non-planer structure, such as a grid or support strips. In one alternative, the base 652 may include wheels or rollers for easily moving the stand 630.

The height that the stand positions the cabinet may vary. The stand may position the jewelry cabinet at a height above the floor to provide easier access to its contents to a user. The stand may also include its own storage elements, such as drawers. In addition, the stand may include wheels or rollers for easily moving the stand.

The jewelry cabinet may be positioned on a stand, or mounted on a wall, or be capable of being switched between a wall mounted and stand mounted configuration.

Figure 32:
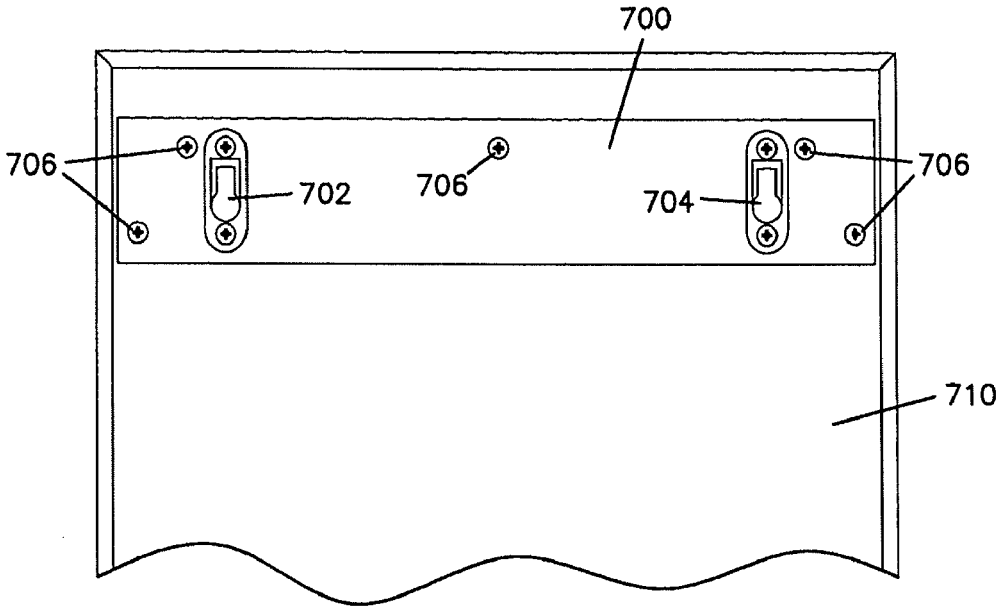
FIG. 32 is a rear view of a wall mounting system for the jewelry cabinet system of the present invention.
Figure 33:
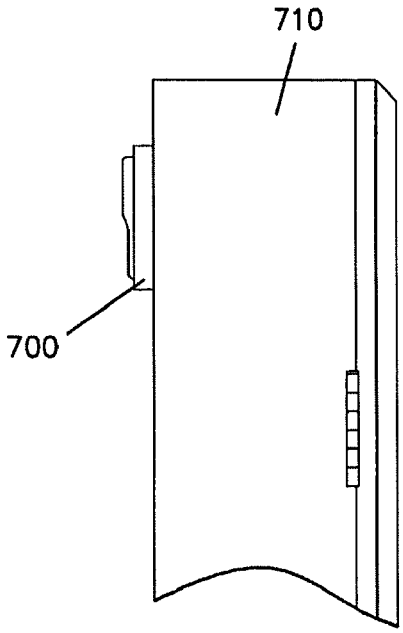
FIG. 33 is a side view of the wall mounting system shown in FIG. 25.

FIGS. 32 and 33 show a mounting bar 700 that may be used to attach a jewelry cabinet to a planar surface, such as a wall. The mounting bar may be provided in addition to the stand, to offer the user the alternative of wall mounting or stand mounting the jewelry cabinet. The mounting bar includes two hook structures 702, 704 for receiving a nail or screw that protrudes from a planar surface. The mounting bar 700 may be attached to a jewelry cabinet 710 using conventional attachment techniques, such as nails or screws. In FIG. 32, five screws 706 secure the mounting bar 700 to a back surface of a cabinet. Of course, any number of different mounting structures could be utilized, such as a metal ring for attachment to a nail or hook on a wall surface, or a saw-toothed flat metal plate for attachment to a nail or hook on a wall surface.

The various embodiments described above are provided by way of illustration only and should not be construed to limit the invention. Those skilled in the art will readily recognize various modifications and changes which may be made to the present invention without strictly following the preferred embodiments and applications illustrated and described herein, and without departing from the true spirit and scope of the present invention which is set forth in the following claims.

What is claimed is:

1. A jewelry storage system for storing and allowing access to and removal of jewelry pieces, comprising:

a jewelry cabinet defining an interior space, the jewelry cabinet comprising:

a frame including a top wall, bottom wall, a first side, a second side and a back wall;

a door connected to the frame; and a plurality of jewelry storage elements located within the interior space; and a stand having a first leg, and a second leg, the jewelry cabinet fitting between the first and second legs of the stand and coupled thereto at a coupling point such that an inside surface of the first leg is adjacent to the first sides of the frame, and an inside surface of the second leg is adjacent to the second side of the frame, wherein the inside surfaces of the first and second legs having a series of holes extending across a width of each leg; and a first, removable peg located in one of the series of holes in the first leg, the first peg extending from the inside surface of the first leg towards the first side of the frame a second removable peg located in one of the series of holes in the second leg, the second peg extending from the inside surface of the second leg towards the second side of the frame, wherein the first and second pegs contact an exterior surface of the back wall of the frame so that the jewelry cabinet is no longer substantially perpendicular to a horizontal plane but is inclined to a non-perpendicular position with respect to the horizontal plane.

2. The jewelry storage system according to claim 1, wherein at least one of the plurality of jewelry storage elements may be relocated within the jewelry cabinet.

3. The jewelry storage system according to claim 1, wherein the plurality of jewelry storage elements includes a bracelet bar and a plurality of shelves attached to one of an interior surface of the frame and the door.

4. The jewelry storage system according to claim 3, wherein the bracelet bar is removably attached to the interior surface of the door, wherein the bracelet bar can be moved and relocated to other locations on the interior surface of the door.

5. The jewelry storage system according to claim 4, wherein the bracelet bar is removably attached to the interior surface of the door by at least one magnet.

6. The jewelry storage system according to claim 3, wherein the plurality of shelves include at least one front wall member, the front wall member extending upward from a front surface of the shelves.

7. The jewelry storage system according to claim 6, wherein the plurality of shelves further include movable dividers that divide a top surface of the shelves.

8. The jewelry storage system according to claim 1, wherein the plurality of jewelry storage elements include a plurality of structures for hanging necklaces attached to at least one of an interior surface of the door and the frame.

9. The jewelry storage system according to claim 8, wherein the plurality of jewelry storage elements further include a pouch, wherein the pouch is located beneath the hook bar and is configured to capture lengthy pieces of jewelry placed on the plurality of hooks.

10. The jewelry storage system according to claim 1, wherein the plurality of jewelry storage elements include an earring bar, the earring bar having a plurality of openings and being attached to at least one of an interior surface of the door and the frame.

11. The jewelry storage system of claim 1, wherein the plurality of jewelry storage elements includes a bracelet bar attached to an interior surface of one of the back wall of the frame and the door, via a mounting element, the bracelet bar including a first pole having a first free end and extending from a first side of the mounting element to the first free end, and a second pole having a second free end and extending from a second side of the mounting element to the second free end, the first and second poles extending approximately parallel to the interior surface and in close proximity thereto.

12. The jewelry storage system of claim 11, wherein the bracelet bar is attached to the interior surface of the door.

13. The jewelry storage system of claim 11, wherein the plurality of jewelry storage elements further includes a plurality of earring bars disposed above the bracelet bar and attached to the interior surface via a first vertical element and a second vertical element, each of the plurality of earring bars extending between the first vertical element and the second vertical elements, and each of the plurality of earring bars including a plurality of slits disposed between the first and second vertical elements.

14. The jewelry storage system of claim 11, wherein the plurality of jewelry storage elements further includes a plurality of hooks attached to the interior surface, being disposed below the bracelet bar.

15. The jewelry storage system of claim 1 wherein the plurality of jewelry storage elements includes a ring storage element comprising a plurality of slits for receiving rings.

16. The jewelry storage system of claim 1 wherein at least a portion of the interior space of the jewelry cabinet is lined with antitarnish cloth.

17. The jewelry storage system of claim 3, wherein the bracelet bar is permanently attached.

18. The jewelry storage system of claim 17, further comprising a mirror attached to the exterior surface of the door.

19. The jewelry storage system of claim 15 wherein the ring storage element is bordered by the first and second sides of the frame.

20. The system of claim 1 wherein a degree of inclination of the jewelry cabinet is dependent upon which of the series of holes the first and second peg are inserted into.

21. A jewelry storage system for storing and allowing access to and removal of jewelry pieces, comprising:

a jewelry cabinet defining an interior space, the jewelry cabinet comprising:

a frame including a top wall, a bottom wall, a first side, a second side and a back wall;

a door connected to the frame; and a plurality of jewelry storage elements attached within the interior space; and a stand having a first leg and a second leg both said first and second legs extending substantially perpendicular to a horizontal plane, the stand receiving the jewelry cabinet between the first and second legs and coupling the jewelry cabinet to the first and second legs, wherein the first and second legs have an interior surface that faces the first side and the second side of the frame and each interior surface has a series of holes extending across a width of each leg; and a first and second removable peg located in one of the series of holes of each leg respectively and extending from the interior surface of each of the first and second legs to contact an exterior surface of the back wall to incline the back wall of the jewelry cabinet from a position substantially perpendicular to a horizontal plane but is inclined to a non-perpendicular position with respect to the horizontal plane.

22. The system of claim 21 wherein a degree of inclination of the jewelry cabinet is dependent upon which of the series of holes the first and second peg are inserted into.

* * * * *